US008133933B2

(12) United States Patent
Rediger et al.

(10) Patent No.: US 8,133,933 B2
(45) Date of Patent: Mar. 13, 2012

(54) BINDER COMPOSITIONS COMPATIBLE WITH THERMALLY RECLAIMING REFRACTORY PARTICULATE MATERIAL FROM MOLDS USED IN FOUNDRY APPLICATIONS

(75) Inventors: Richard Rediger, Conyers, GA (US); Edward Lucas, Asbury, WV (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 935 days.

(21) Appl. No.: 11/464,025

(22) Filed: Aug. 11, 2006

(65) Prior Publication Data

US 2007/0112092 A1 May 17, 2007

Related U.S. Application Data

(60) Provisional application No. 60/736,294, filed on Nov. 15, 2005.

(51) Int. Cl.
*B22C 1/22* (2006.01)

(52) U.S. Cl. ..... 523/145; 523/139; 523/146; 523/200; 523/206; 523/208; 524/445; 524/446; 524/540; 524/541; 524/542; 524/593; 524/594; 524/595; 524/596; 524/597; 524/598; 524/611; 524/612; 525/390; 525/398; 525/472; 525/534; 525/540; 528/86; 528/129; 528/162; 528/212; 528/215; 528/230; 528/266; 528/422

(58) Field of Classification Search ..... 523/145, 523/139, 146, 200, 206, 208; 524/445, 446, 524/540, 541, 542, 593, 594, 595, 596, 597, 524/598, 611, 612; 525/390, 398, 472, 534, 525/540; 528/86, 129, 162, 212, 215, 230, 528/266, 422

See application file for complete search history.

(56) References Cited

U.S. PATENT DOCUMENTS

| | | | | |
|---|---|---|---|---|
| 4,124,554 | A | 11/1978 | Fry | |
| 4,132,699 | A * | 1/1979 | Bannister et al. | 523/145 |
| 4,157,993 | A * | 6/1979 | Funabiki et al. | 523/145 |
| 4,197,385 | A * | 4/1980 | Laitar | 525/501 |
| 4,252,700 | A | 2/1981 | Funabiki et al. | |
| 4,397,967 | A | 8/1983 | McDonald | |
| 4,403,076 | A | 9/1983 | McDonald | |
| 4,426,484 | A | 1/1984 | Saeki et al. | |
| 4,429,642 | A * | 2/1984 | Deve | 110/236 |
| 4,460,717 | A | 7/1984 | Saeki et al. | |
| 4,644,022 | A * | 2/1987 | Iyer | 523/144 |
| 4,767,801 | A * | 8/1988 | Suzuki et al. | 523/145 |
| 5,082,876 | A * | 1/1992 | Iyer et al. | 523/145 |
| 5,552,186 | A | 9/1996 | Bourlier et al. | |
| 6,706,845 | B2 | 3/2004 | Ingram et al. | |

FOREIGN PATENT DOCUMENTS

| | | |
|---|---|---|
| JP | 53-058430 | 5/1978 |
| JP | 54-028357 | 3/1979 |

OTHER PUBLICATIONS

Roeth, G., "Investigations of the compatibility of reclaimed organically bonded product on sands with various resin binder systems as well as the reclaimability of foundry sands," Giessereiforschung, 50(1):10-24 (1998).

Oehlerking, T., "Usability of reclaimed material from combined thermal reclamation of different core sands," Giesserei, 80(21):721-8 (1993).

Granlund, M., et al., "Thermal-pneumatic reclamation of molding sand for reuse in core work," Transactions of the American Foundrymen's Society, 91:101-8 (1983).

Knop, A., et al., Phenolic Resins—Chemistry, Applications and Performance, "Reaction Mechanisms," Publisher: Springer-Verlag, Chapter 3, pp. 24-54 (1985).

Knop, A., et al., Phenolic Resins—Chemistry, Applications and Performance, "Resin Production," Publisher: Springer-Verlag, Chapter 5, pp. 91-102 (1985).

Knop, A., et al., Phenolic Resins—Chemistry, Applications and Performance, "Foundry Resins," Publisher: Springer-Verlag, Chapter 16, pp. 256-261 (1985).

Rempp and Merrill, Polmer Synthesis, Huthig and Wepf, pp. 56-57 (1986).

* cited by examiner

*Primary Examiner* — Vasu Jagannathan
*Assistant Examiner* — Richard A Huhn
(74) *Attorney, Agent, or Firm* — Michael S. Kerns

(57) ABSTRACT

Phenolic resin binder systems for sand molds, used in metal casting, which improve the quality of thermally reclaimed sand, are described. The substantial or complete elimination of calcium compounds (e.g., calcium stearate and calcium hydroxide, conventionally employed as a mold lubricant and a resin curing catalyst, respectively) allows the thermally reclaimed sand to be reused over multiple thermal reclamation cycles without the adverse effects previously encountered.

22 Claims, No Drawings

BINDER COMPOSITIONS COMPATIBLE WITH THERMALLY RECLAIMING REFRACTORY PARTICULATE MATERIAL FROM MOLDS USED IN FOUNDRY APPLICATIONS

CROSS-REFERENCE TO RELATED APPLICATIONS

This application claims the benefit of priority of U.S. Provisional Patent Application No. 60/736,294, filed Nov. 15, 2005, which is hereby incorporated by reference in its entirety.

FIELD OF THE INVENTION

The present invention relates to phenolic resin binder compositions used to coat and, after curing, bind refractory particulate material (e.g., sand). Molding compositions comprising refractory particulate material that is coated with the phenolic resin binder are used in the formation of shell molds and cores for casting metal and other materials. Such molding compositions offer a number of advantages in the thermal reclamation of refractory particulate material therefrom.

BACKGROUND OF THE INVENTION

Foundries use refractory granules such as sand, which is bound together with a resin binder, to form shell molds and cores used for casting metal and other molten materials. Typically, a minor proportion of uncured resin and curing agent are combined with new and/or reclaimed refractory particulate material (e.g., sand). The resulting composition is mulled or kneaded at elevated temperature, such that the resin is uniformly dispersed (coated) over the refractory particulate material. The resin-coated refractory particulate material, or molding composition, is then placed onto a heated pattern, which is used to form the refractory particulate material into a desired shell or core shape. The heat from the pattern, which is generally later accompanied by external heat from the opposite or outer side of the refractory particulate material layer, is used to set or cure the resin binder and provide a rigid, cured refractory particulate material mold. A shell mold may be formed by gluing two refractory particulate material mold halves, prepared in this manner, together to form a cavity suitable for retaining molten metal (e.g., iron or steel) in metal casting operations. A core mold is optionally placed within a shell mold, if a hollow metal casting is desired.

Various agents, such as mold lubricants (e.g., calcium stearate), may be added to the resin binder to improve the flow/packing characteristics of the molding composition, resulting in higher density and strength of the cured mold. Clay is also sometimes added to sand and incorporated into the molding composition to improve the finish of the cast metal.

In preparing cast metal articles, after molten metal is introduced into the mold cavity, the metal is cooled as its heat is transferred to the mold, causing the resin binder to break down. This allows for a clean and efficient removal of the remaining refractory particulate material (e.g., sand or sand/clay blend) from the cast metal article. In some cases, particularly when the cast metal has a low melting point, mechanical force may be needed to break the mold and/or calcination may be needed to sufficiently thermally degrade the binder in the mold.

After separation of the refractory particulate material from the cast metal article, it is advantageously subjected to thermal reclamation, whereby the organic materials of the binder are more completely volatilized (i.e., burned off). This allows for reuse of the refractory particulate material after a number of cycles of preparing molding compositions and casting metals as described above. The ability to thermally reclaim the refractory particulate material, however, has traditionally been limited by the gradual reduction in quality, and particularly the strength characteristics, of the molds made from the thermally reclaimed refractory particulate material, from one thermal reclamation cycle to the next. The standard industry practice of addressing this problem, prior to each thermal reclamation cycle, is to improve the quality of the refractory particulate material by removing clay materials, diluting it with fresh refractory particulate material, and/or washing it to remove calcium.

Various issues associated with refractory particulate material reclamation are discussed in the art. For example, Roeth G., et al Giessereiforschung, 50(1): 10-24 (1998) characterizes reclaimed molding sands in terms of a number of selected criteria. Oehlerking, T. Geisserei, 80(21): 721-8 (1993) evaluates the usability of reclaimed molding sand as a function mixing ratios and other parameters. Granlund, M. et al. Transactions of the American Foundrymen's Society, 91:101-8 (1983) describes the benefits of calcination in thermal reclamation.

Phenolic resins and especially phenol-formaldehyde resins such as novolacs have gained acceptance as binders in the production of the shell and core molds described above due to their excellent performance in this demanding service. In many cases, novolac resin that is a solid at ambient temperature (e.g., novolac flake) is melted onto the heated refractory particulate material to provide the molding composition. Also, particularly in the case of a novolac, a polyfunctional curing agent such as hexamethylenetetramine (hereinafter "hexamine") is required to cross-link and harden the resin. A sufficient quantity of hexamine is required to achieve a suitable tensile strength of the mold for metal casting.

While hexamine can convert thermoplastic novolac resins into desired thermosetting resins, hexamine is known to emit pollutant/contaminant gases such as ammonia, amines, and formaldehyde as a result of these cross-linking reactions during the refractory particulate material coating and molding operations, as well as during pyrolysis of the iron or steel casting. Smoke and odors resulting from the use of hexamine are also significant concerns. Moreover ammonia and amines that remain in the molds can corrode the cast metal products, as well as lead to mechanical failure and defects such as pinholes or blow holes, due to the volatilization of these components.

To offset some of the above-noted disadvantages associated with the use of hexamine, some resin binder systems incorporate a thermosetting phenolic resole, together with the novolac, in order to reduce the amount of hexamine required for curing. Phenolic resole resins exhibit slower curing characteristics and are more difficult to control in terms of their degree of polymerization, when compared to purely novolac/hexamine systems. Additives are therefore generally used to catalyze and better control the cure of phenolic resole resins. Such additives are described, for example, in Japanese Patent Publication Nos. 53-58430 and 54-28357 and include hydroxides, oxides of magnesium, zinc and barium, bisphenol S, catechol, reactive phenols such as resorcinol, and acids such as salicylic acid.

Various phenolic resin binder compositions are described in the art. For example, U.S. Pat. No. 4,460,717 describes a phenolic resin comprising an aromatic ring compound, which purportedly allows for greater ease of removal of the mold from the cast metal, when this metal has a lower melting temperature than iron.

U.S. Pat. No. 4,426,484 describes phenolic resole resin binders having specified cure characteristics that are used to coat sand and prepare molding materials.

U.S. Pat. No. 4,252,700 describes the use of a lubricant-containing solid resole resin, as a curing agent for a novolac resin to provide faster curing, increase cross-link density, and achieve various other properties in binding sand used to form molds.

U.S. Pat. Nos. 4,397,967 and 4,403,076 describe novolac resins having improved cure speed, which are used to coat sand for the preparation of molds and cores having good tensile strength properties.

The art has not satisfactorily addressed the problems described above that prevent the reuse of refractory particulate material over a significant number of thermal reclamation cycles, in molding compositions comprising a phenolic resin binder. Accordingly, there remains a need for phenolic resin binder systems that allow refractory particulate material to be reused over multiple thermal reclamation cycles, without suffering from a loss in tensile strength and/or higher crumbling and cracking tendency of the resulting molds over time, especially when a sand/clay blend is used. Ideally, such binder systems also should have low emissions (including volatile organic carbon (VOC), ammonia, amines, smoke, and odors), a low tendency to form defects in the cast metal articles, and consequently a low requirement for the use of hexamine as a hardening agent to compensate for lost tensile strength. The binder systems should have various properties, discussed hereinafter, that are well suited to the formation of molding compositions. For example, the binders should be able to hold the shape of the mold as it is cured, without the separation of partially-cured or tacky molding composition (a phenomenon known as "peelback"). The binder systems should also provide good finishing characteristics of cast metal articles prepared from the molds, whether or not clay is incorporated into the molding composition.

BRIEF SUMMARY OF THE INVENTION

Phenolic resin binder systems for refractory particulate material (e.g., sand) molds used in metal casting have now been discovered which greatly improve the ability of thermally reclaimed refractory particulate material to be reused over many thermal reclamation cycles. In particular, the substantial or complete elimination of calcium compounds, such as calcium stearate and calcium hydroxide, conventionally employed as a mold lubricant and as a resin curing catalyst, respectively, has been found to improve the quality of thermally reclaimed refractory particulate material, without disadvantageously impacting the performance of the resin binder in preparing reclaimed refractory particulate material molds. While organic residues originating from the binder are efficiently removed by thermal reclamation of the refractory particulate material used in molds, calcium compounds are converted to calcium oxide which remains on the refractory particulate material and gradually accumulates over the course of several thermal reclamation cycles. Without being bound by theory, it is believed that the accumulated calcium results in the observed decrease in the strength of molds, over time, that are made from thermally reclaimed refractory particulate material.

Moreover, it is thought that the addition of aluminum-containing clay in sand/clay blends exacerbates this problem, due to interactions between the accumulated calcium oxide and accumulated aluminum oxide (originating from the clay) which adversely impact ability of the sand to form strong, rigid molds. Therefore, the substantial elimination of calcium compounds from the binder system advantageously allows for the long-term thermal reclamation of sand/clay blends for forming metal casting molds with high tensile strength. Surprisingly, substantially non-calcium containing binder systems of the present invention exhibit other favorable qualities, including low emission smoke formation, good mold forming properties (e.g., low peelback), together with other desired characteristics, described herein.

Accordingly, in one embodiment, the present invention is a molding composition comprising refractory particulate material (e.g. sand) that is coated with a resin mixture. The resin mixture comprises a phenolic novolac resin, a phenolic resole resin, and hexamine and is substantially free of calcium. In another embodiment, the resin mixture comprises calcium in an amount representing less than about 100 ppm of the combined weight of the phenolic novolac and the phenolic resole. In another embodiment, the resin mixture further comprises salicylic acid in an amount of less than about 1.5% by weight of the combined dry solids weight of the phenolic novolac and the phenolic resole. In another embodiment, the resin mixture comprises farther urea in an amount from about 0.08% to about 0.8% by weight of the combined dry solids weight of the phenolic novolac and the phenolic resole. In another embodiment, the resin mixture further comprises free formaldehyde in an amount of less than about 0.15% by weight of the combined dry solids weight of the phenolic novolac and the phenolic resole.

In another embodiment, the molding composition has a weight ratio of refractory particulate material (e.g., sand) to the combined dry solids in the phenolic novolac and the phenolic resole from about 10:1 to about 35:1. In another embodiment, the molding composition, when cured, exhibits a one minute cold tensile strength, as defined hereinafter, of at least about 400 psi. In another embodiment, the molding composition, when cured, exhibits a three minute hot tensile strength, as defined hereinafter, of at least about 225 psi. In another embodiment, the molding composition, when cured, exhibits a peelback at 60 seconds, as defined hereinafter, of at least about 2 kg. In another embodiment, the molding composition further comprises a sand/clay blend with clay present in an amount from about 1% to about 10% by weight of the sand.

In another embodiment, the present invention is a mold for casting metallic articles. The mold comprises refractory particulate material (e.g., sand) and a resin mixture as described above, after it is cured. In particular, the mold is prepared by forming a mass of the molding composition or coated sand into a desired shape and heating the molding composition sufficient to cure the resin mixture. In another embodiment, at least part of the refractory particulate material used to prepare the mold has been previously thermally reclaimed. In other embodiments, at least part, or substantially all, of the refractory particulate material used to prepare the mold has been previously subjected to from about 10 to about 50 thermal reclamation cycles.

In another embodiment, the present invention is a method for preparing a coated refractory particulate material (e.g., sand) useful as a molding composition. The method comprises combining refractory particulate material and a solid (e.g., flaked) phenolic novolac resin at conditions sufficient to melt the phenolic novolac resin and yield a novolac resin coated refractory particulate material. The method further comprises adding a liquid phenolic resole resin and hexamine to the novolac resin coated refractory particulate material to yield the coated refractory particulate material useful as a molding composition, wherein the phenolic novolac resin and the phenolic resole resin are substantially free of calcium.

In another embodiment, the present invention is a method for preparing a mold for casting metallic articles. The method comprises forming the molding composition, prepared as described above, into a desired shape and curing the resin mixture, comprising the phenolic novolac resin and the phenolic resole resin, with heat to yield the mold.

In another embodiment, the present invention is a method for preparing a cast metal article. The method comprises contacting molten metal with the mold prepared as described above, while allowing the surface of the molten metal to degrade the mold and release the refractory particulate material (e.g., sand). The method further comprises cooling the molten metal to form the cast metal article, having a shape determined by the mold. In another embodiment, the method further comprises, after the removing step, thermally reclaiming refractory particulate material from the mold and thereafter reusing the refractory particulate material in the preparation of a new mold for casting metallic articles.

These and other embodiments are apparent from the following Detailed Description.

DETAILED DESCRIPTION OF THE INVENTION

The present invention is based on the discovery that certain resin binder compositions, when used to prepare refractory particulate material (e.g., sand) molds for metal casting operations, allow the refractory particulate material to be thermally reclaimed, without various detrimental effects observed using conventional resin binders. These effects include loss of mold integrity and tensile strength, which are generally encountered after multiple reuses of thermally reclaimed refractory particulate material. In particular, it has been found that the substantial elimination of calcium compounds from the phenolic resin binder permit the repeated use of thermally reclaimed refractory particulate material without the rapid deterioration in mold quality conventionally observed. This improved performance is thought to be a consequence of greatly reducing the accumulation of metal oxides (e.g., calcium and/or aluminum oxide) on the refractory particulate material over multiple thermal reclamation cycles. With conventional binder systems, this resulted in the gradual deterioration of mold quality, and especially the cured binder strength.

Calcium compounds, such as calcium stearate and calcium hydroxide, are known to provide good flow characteristics and enhanced resin cure speed in molding compositions comprising refractory particulate material. Phenolic resin binder compositions of the present invention, however, posses characteristics (e.g., low volatile emissions, high strength, low peelback, and good mold forming capability) that are highly desirable in commercial foundry applications, without the use of these calcium compounds. As such, these compositions, among other advantages, now provide the art with a means to accommodate long-term thermal reclamation of molding refractory particulate material in a simple manner as part of foundry operations.

Phenolic resin binder compositions, or resin mixtures, of the present invention comprise a mixture of a phenolic novolac resin and a phenolic resole resin. Advantageously, the use of a phenolic resole, which is thermosetting, reduces the requirement for hexamine which is otherwise needed to cross-link or cure the novolac resin. The "two-part" resin binder system of the present invention therefore provides reduced VOC, amine, ammonia, and formaldehyde emissions (associated with the thermal break down of hexamine) relative to novolac/hexamine systems without added phenolic resole. The reduction in hexamine also reduces smoke and odor problems encountered in foundry operations.

Both the phenolic novolac resin and the thermosetting phenolic resole resin can be obtained as the reaction product of an aromatic alcohol (e.g., phenol) and an aldehyde (e.g., formaldehyde). An elevated temperature, generally from about 50° C. to about 150° C. (about 120° F. to about 300° F.) at a time from about 15 minutes to about 3 hours, is normally required to cause alkylolation (e.g., methylolation) of at least some of the reactive sites of the aromatic alcohol by the aldehyde. Alkylolation refers to the addition of a hydroxyalkyl functionality at reactive sites (generally the ortho- and para-positions of the aromatic rings) of the aromatic alcohol, to form an adduct. With respect to the preparation of a phenol-formaldehyde adduct, for example, process parameters are well known in the art and described, for example, in U.S. Pat. No. 6,706,845. To verify that the alkylolation has proceeded to a desired degree, the extent of reaction between the aromatic alcohol and the aldehyde may be monitored directly, for example, by sampling the reaction product for free aromatic alcohol or aldehyde content. Otherwise, a number of indicia (e.g., viscosity or refractive index) are known in the art as a means of monitoring the progress of the reaction indirectly. The manufacture of phenolic resins is described, for example, by Gardziella, L. et al., Phenolic Resins: Chemistry, Applications, Standardization, Safety, and Ecology, Springer-Verlag (1999).

The phenolic novolac resin generally is prepared using an acidic catalyst such as sulfuric or oxalic acid. The reaction temperature may range from 80° C. to 120° C. (176° F. to 248° F.). Under acidic conditions the initial alkylolated species resulting from the reaction between an aromatic alcohol and an aldehyde reacts with another aromatic alcohol, to join it via a methylene bridge. A dimer is formed, for example, in the common situation where both of the aromatic alcohol molecules are the same (e.g. both phenol). The geometry of the bridge between the aromatic alcohols may be ortho-ortho (OO'), ortho-para (OP') or para-para (PP'), and as is known this geometry is influenced by the acid catalyst. The dimer that is initially formed continues to react with unbound formaldehyde and/or other alkylolated species to form the final polymer chain. Dimer compositions are described in the Gardziella reference indicated above and others. The development of resin molecular weight during reaction may be monitored by Gel Permeation Chromatography (GPC), solution viscosity, or other suitable method known to those having skill in the art. Following the reaction, water and excess phenol are usually removed in the overhead of an atmospheric and/or vacuum distillation operation.

The "cooking" conditions, which include the reaction time and temperature, are used to control subsequent condensation reactions of the adduct to advance the polymerization degree and consequently the reaction product molecular weight. Condensation is therefore used to form a resin polymer where at least part of the alkylolated monomer species are joined by alkylene ether bridges or alkylene bridges (after further condensation). The molecular weight of the condensed product may be estimated from the viscosity and/or the refractive index of the reaction product. In the case of a phenol-formaldehyde resin, the extent of the condensation reactions and resin molecular weight may also be estimated from analysis of the free phenol remaining in the reaction product, where higher degrees of polymerization are associated with lower amounts of free phenol. The fee phenol content of the phenolic resole is generally less than about 0.5% by weight, more typically less than about 0.4% by weight, and often less than about 0.1% by weight.

One difference between a novolac and a resole resides in the molar ratio of aldehyde to aromatic alcohol used in the preparation. In contrast to novolacs, resoles are thermosetting or "heat reactive" by virtue of having, on average, more than one reactive alkylol functionality per aromatic alcohol and thus have residual alkylol site which are available to form cross links upon heating, even in the absence of an added cross linking agent, curing the resin to form a rigid polymeric structure. Novolacs are generally prepared with less than one mole of aldehyde per mole or aromatic alcohol. In addition, novolac resins often are prepared at an acidic pH while phenolic resole resins generally are prepared at an alkaline pH.

As stated previously, in order to become heat reactive, novolacs require the addition of a cross linking agent such as hexamine. Novolacs and resoles are known in the art and described, for example, in Rempp and Merrill, Polymer Synthesis, Huthig & Wepf (1986), p. 56-57. The phenolic novolac resins will therefore generally comprise the product of the reaction of an aldehyde (e.g., formaldehyde) and an aromatic alcohol (e.g., phenol) at a molar ratio of aldehyde to aromatic rings in the aromatic alcohol (known as the "F/P ratio") from about 0.5:1 to about 1:1, and more typically is from about 0.7:1 to about 0.9:1. The phenolic resole will generally have an F/P ratio from about 1.3:1 to about 4:1, typically from about 2.0:1 to about 3.5:1, and often from about 2.5:1 to about 3.5:1.

Representative of suitable aldehydes that may be used to form either the phenolic novolac or phenolic resole are formaldehyde, or other aliphatic aldehydes such as acetaldehyde, propionaldehyde, n-butylaldehyde, n-valeraldehyde, n-caproaldehyde, and n-heptylaldehyde. Aldehydes also include aromatic aldehydes (e.g., benzylaldehyde and furfural), and other aldehydes such as glyoxal, and crotonaldehyde. Combinations of aldehydes may also be used. Due to its commercial availability and relatively low cost, formaldehyde is generally used.

Skilled practitioners recognize that formaldehyde is commercially available in many forms. Any form which is sufficiently reactive and which does not introduce extraneous moieties deleterious to the desired reaction product can be used in the preparation of heat reactive resins useful in the invention. For example, commonly used forms of formaldehyde include paraform (solid, polymerized formaldehyde) and formalin solutions (aqueous solutions of formaldehyde, sometimes with methanol, generally in 37 percent, 44 percent, or 52 percent formaldehyde concentrations). Formaldehyde also is available as a gas. Typically, formalin solutions are used as the formaldehyde source. Formaldehyde may also be substituted in whole or in part with any of the aldehydes described above (e.g., glyoxal). Materials that form formaldehyde in situ can also be employed.

If formaldehyde is used as the aldehyde reactant in either of both the phenolic novolac or phenolic resole, the free formaldehyde content of the phenolic resin binder composition of the present invention will generally be below 5%, more typically below 3%, and usually below 1%. A low content of formaldehyde is generally desired to limit exposure to formaldehyde emissions. Optionally, conventional "formaldehyde scavengers" that are known to react with free formaldehyde may be incorporated into the binder composition to reduce the level of free formaldehyde.

Representative of suitable aromatic alcohols that may be used to form either the phenolic novolac or phenolic resole are phenol; phenol alkylated with one or more alkyl moieties having up to about 10 carbon atoms, such as o-, m-, and p-cresol, xylenols (e.g., 3,4-xylenol or 3,5-xylenol), p-tert-3,4,5-trimethylphenol, 3-ethyl phenol, 3,5-diethyl phenol, p-butyl phenol, 3,5-dibutyl phenol, and p-amylphenol. Other aromatic alcohols include p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol. Additionally, aromatic alcohols include the class of compounds commonly known as bisphenols, (e.g., 4,4'-alkylidene-diphenol). Examples of suitable bisphenols that can be used include 4,4'-isopropylidene-diphenol (commonly known as bisphenol-A), 4,4'-methylidene-diphenol (commonly known as bisphenol-F), and 4,4'-sec-butylidene-diphenol. Combinations of aromatic alcohols, such as those obtained from blending bisphenol-A with a small amount of another di-functional phenol (e.g., resorcinol, catechol, hydroquinone, or p,p'-dihydroxy biphenyl) may also be used. Of these aromatic alcohols, phenol is typically used.

The phenolic novolac and phenol resole resins used to coat sand and other refractory particulate materials to form molding compositions of the present invention may be prepared in various forms such as aqueous solutions, dispersions, or emulsions. The advantages of aqueous resins include the elimination of solvent emissions. The preparation of aqueous dispersions of phenol-formaldehyde resins is described, for example, in U.S. Pat. Nos. 4,124,554 and 5,552,186. The solubility of any particular phenolic resin in an aqueous solvent is a function of its molecular weight. Therefore, a low molecular weight resin, for example, may be in solution form (i.e., dissolved in a liquid solvent), whereas a higher molecular weight resin may be in the form of a dispersion.

The phenolic novolac and phenolic resole resins may initially be liquid or solid forms of "neat" resins having few or no volatile components, obtained by conventional drying techniques (e.g., spray drying). Otherwise, these resins may be in the form of dispersions or solutions, generally containing from about 40% to about 90% dry solids or non-volatiles. The dry solids or non-volatiles content is measured by the weight loss upon heating a small (e.g., 1-5 gram), sample of the resin at about 135° C. for about 3 hours. When used in aqueous solution or dispersion form, the phenolic resins will generally have, at 25° C., a Brookfield viscosity from about 100 to about 5,000 cps, a specific gravity from about 1.002 to about 1.25 g/ml, and a pH from about 8.0 to about 10. Typically, the phenolic novolac resin is initially present in a solid form (e.g., novolac flake) that can be melted onto hot refractory particulate material (e.g., sand), to which the phenolic resole is added in a liquid form containing from about 55% to about 75% resin solids.

The phenolic novolac and phenolic resole resins of the present invention generally each have number average molecular weights ($M_n$) from about 50 to about 1000 grams/mole, and typically from about 100 to about 500 grams/mole. As is known in the art, the value of $M_n$ of a polymer sample having a distribution of molecular weights is defined as $$M_n = \frac{\sum_i N_i M_i}{\sum_i N_i},$$

where $N_i$ is the number of polymer species having i repeat units and $M_i$ is the molecular weight of the polymer species having i repeat units. The number average molecular weight is typically determined using gel permeation chromatography (GPC), with the solvent, standards, and procedures well known to those skilled in the art. This quantity $M_n$ is normally determined relative to a given polystyrene molecular weight standard.

Molding compositions of the present invention comprise a refractory particulate material (e.g., sand) at least partially coated with a mixture of resins that cures to bind the particulate and provide a rigid mold for preparing cast metal articles. The resin mixture, or hinder composition, comprises the phenolic novolac and phenolic resole resins described above, as well as a minor amount of hexamine. The phenolic novolac resin is generally present in the molding composition in an amount from about 2% to about 6% by weight, and typically from about 3% to about 5% by weight, based on the refractory particulate weight. The phenolic resole resin is generally present in the molding composition in an amount from about 0.5% to about 3% by weight resin solids, and typically from about 1% to about 2% by weight resin solids, based on the refractory particulate weight. The phenolic novolac generally has a dry solids weight from about 60% to about 99%, typically from about 70% to about 98%, and often from about 75% to about 95%, of the combined dry solids weight of the phenolic novolac and phenolic resole.

The refractory particulate material may comprise a metal oxide, mineral, or ceramic material. Metal oxides include the various oxides of silicon, aluminum, zirconium, titanium barium, iron, nickel, manganese, zinc, as well as mixed metal oxides. This latter category also includes naturally occurring minerals such as mica (a generic term for a family of about 30 aluminum-containing silicates). Suitable refractory particulate materials include both amorphous materials (e.g., amorphous silica, alumina, zirconia, titania, etc.) as well as crystalline materials (e.g., quartz, zeolitic materials such as silicalite and mordenite, non-zeolitic molecular sieves, etc.). The refractor particulate material generally has a weight average particle size (i.e., the particle diameter which is exceeded by 50% of the material weight) from about 50 μm to about 1000 μm (about 16 to about 300 mesh), and more typically from about 100 μm to about 500 μm (about 35 to about 150 mesh).

Sand is the most commonly employed refractory particulate material due to its great abundance in nature and correspondingly low cost. While molding compositions and molds of the present invention are described hereinafter as comprising sand, it is understood that other refractory particulate materials could be employed with the expectation of equivalent benefits and advantages. In the case of sand, any type of sand conventionally used in the art for making sand molds for use in foundry operations. Representative types of sand include silica (white sand) and bank/lake (brown or "play box" sand), as well as various specialty, high specific gravity sands such as zircon, olivine, and chromate.

Sand may also be blended with clay, as is known in the art, if certain properties in the finish of the cast metal article are desired. With conventional calcium-containing binder systems, the thermal reclamation of sand/clay blends was especially problematic due to the accumulation of both calcium oxide and aluminum oxide on the sand, combined with detrimental interactions between these contaminants which further degraded the quality of the sand, with respect to its ability to form strong molds. The substantial elimination of calcium from binder compositions of the present invention, however, alleviates these problems, so that sand/clay blends may be reclaimed and reused in the formation of molds, over multiple thermal reclamation cycles without suffering from the above-noted disadvantages. When clay is mixed with sand, the clay is generally present in the molding composition in an amount from about 1% to about 10%, more typically from about 2% to about 8%, of the weight of the sand.

The amount of hexamine is normally present in the molding composition of the present invention in an amount from about 1% to about 5% by weight, and more typically from about 2% to about 4% by weight, based on the weight of the resin mixture. The amount of hexamine added, however, is often based on the amount of phenolic novolac resin, since it predominantly acts as a cross-linking agent for the novolac. In this regard, the hexamine is normally present in an amount from about 3% to about 8% by weight, and more typically from about 4% to about 6% by weight, based only on the weight of the phenolic novolac resin. This relatively low amount of hexamine, compared to that employed in conventional binder compositions, based on the principal use of novolac resin, results from the use of some thermosetting phenolic resole in the binder composition, but it is also partly a consequence of the substantial elimination of calcium from this composition. As stated above, in the case of refractory particulate material (e.g., sand) that is subjected to ongoing thermal reclamation cycles, calcium in the binder composition adversely affects the refractory particulate material quality over time, such that molds made from thermally reclaimed refractory particulate material having significant accumulated calcium suffer from lack of tensile strength, crumbling, and/or cracking.

Previous attempts to offset this phenomenon focused on increasing the hexamine content of the resin binder system to increase the degree of crosslinking and therefore improve mold strength. The substantial elimination of calcium in the resin mixture (and therefore molding compositions) of the present invention, however, prevents the accumulation of unwanted metallic oxide deposits on thermally reclaimed refractory particulate material (e.g., sand) and thereby obviates the requirement for additional hexamine to compensate for the mold tensile strength losses, resulting from such deposits. The low hexamine amounts are highly desirable with respect to reducing emissions (including VOCs, ammonia, amines, smoke, and odors).

The two-part phenolic resin binder systems of the present invention also provide low formaldehyde emissions, which are of increasing concern with respect to the air quality in foundry operations. Excess amounts of free (unreacted) formaldehyde in the binder, which stein from the phenolic resole resin, may be neutralized with aqueous and/or organic bases such as ammonium hydroxide and/or urea. Normally, the free formaldehyde content of the phenolic resole resin will be less than about 1% by weight, which generally equates to an amount of less than 0.3% by weight of the combined dry solids weight of the phenolic novolac and phenolic resole used in the resin mixture. The amount of urea added to the phenolic resole resin to contribute to this low formaldehyde level is normally from about 0.3% to about 3% by weight resole resin solids, which generally equates to an amount from about 0.08% to about 0.8% by weight of the combined dry solids weight of the phenolic novolac and phenolic resole used in the resin mixture.

The binder composition and associated molding composition are substantially free of calcium. That is, essentially no calcium-containing compounds, traditionally used, for example, as lubricants and catalysts, are incorporated into the molding composition with either the phenolic novolac resin or the phenolic resole resin. The term "substantially free" means that calcium, if present in the molding composition, represents less than about 1000 ppm by weight, typically less than about 500 ppm by weight, and usually less than about 100 ppm by weight, of the combined weight of dry solids of the phenolic novolac and the phenolic resole, where the dry solids content is determined as described above. These quantities are based on the amount of calcium only (i.e., calculated based on the amount of elemental calcium) and not the total weight of calcium containing compounds.

While calcium hydroxide is conventionally used as a catalyst for phenolic resin binder systems for making refractory particulate material molds, molding compositions of the present invention may advantageously employ non-calcium containing catalysts, including sodium hydroxide and/or salicylic acid, both of which increase the cure speed and contribute to the durability of the refractory particulate material mold. If sodium hydroxide is included in the phenolic resole, it is normally present in an amount from about 1% to about 5% by weight, and typically from about 2% to about 3% by weight of resole resin solids. This generally equates to an amount from about 0.3% to about 1.5% by weight, and typically from about 0.5% to about 1% by weight, of the combined dry solids weight of the phenolic novolac and phenolic resole used in the resin binder composition. If salicylic acid or oxalic acid is included in the phenolic resole, it is normally present in an amount of at least 0.5% by weight but generally less than about 5% by weight, and typically less than about 4% by weight, of resole resin solids. This generally equates to an amount of less than about 1.5% by weight, and typically less than about 1% by weight, of the combined dry solids weight of the phenolic novolac and phenolic resole used in the resin mixture. In general, reducing the quantity of salicylic acid is beneficial in terms of reducing visible smoke during shell/core mold production operations.

Molding compositions of the present invention comprise predominantly a refractory particulate material at least partially coated with a smaller amount of the resin mixture, or binder composition. The refractory particulate material binder ratio may be adjusted, as is known in the art, depending on the desired characteristics of the mold (e.g., shell or core, size, thickness, etc.). Generally, the weight ratio of refractory particulate material in the molding composition to the combined dry solids in the phenolic novolac and phenolic resole resins is from about 10:1 to about 35:1, and more typically is from about 15:1 to about 25:1. This refractory particulate material/binder ratio, as well as the relative amounts of novolac and resole resins used in the binder, can be adjusted according to the type of molten metal used in a particular metal casting operation. Molten iron, molten steel, and molten aluminum, for example, have significantly different melting temperatures and other properties that warrant differences in the associated molding compositions.

Extensive development work focused on evaluating the effect of a number of characteristics, described above, of essentially calcium-free binders on the resulting quality of molding compositions, to arrive at the binder systems and molding compositions of the present invention. The performance of molding compositions is normally assessed by standard analytical methods, for example those published by the American Foundrymen's Society (Des Plaines, Ill.). Many of these analyses are conducted on the molding compositions (i.e., refractory particulate material that is coated with uncured (e.g., B-staged resin). Molding compositions of the present invention usually have a melting (melt flow) point in the range from about 80° C. (180° F.) to about 105° C. (220° F.), among a number of other commercially desirable properties. These include a one-minute hot tensile strength of at least about 100 psi, and typically from about 120 to about 160 psi; a three-minute hot tensile strength of at least about 225 psi, and typically from about 240 psi to about 300 psi, a one-minute cold tensile strength of at least about 400 psi, and typically from about 415 psi to about 500 psi; a peelback at 60 seconds of at least about 2 kg, and typically from about 2.5 kg to about 4 kg; a 30 second invest thickness of at least about 0.4 inches, and typically from about 0.45 inches to about 0.55 inches; an invest cure time of at most about 150 seconds, and typically from about 110 seconds to about 130 seconds; and a 60 second "stick point" temperature of at least about 93° C. (200° F.), and typically from about 100° C. (210° F.) to about 120° F. (250° F.).

As is known to those of skill in the art, the one-minute and three-minute hot tensile strength, as well as the one-minute cold tensile strength analyses involve curing a sample of the molding composition in a specified mold pattern for the named time period. In the one-minute and three-minute hot tensile strength analyses, the tensile strength of the resulting mold is then measured in its hot condition. These analyses provides a measure of the initial handling characteristics of the hot mold, including its ability to resist breakage and/or crumbling, to handle gluing together of mold halves and/or transfer to metal pouring operations, etc. For example, three-minute hot strength values in the range of 100-150 psi have been found to result in breakage and crumbling of the hot molds in normal foundry operations. In the one-minute cold tensile strength analysis, the mold is cooled to ambient temperature prior to measuring tensile strength. This analysis provides a measure of the mold strength in metal casting operations, just prior to its contact with molten metal.

The peelback at 60 seconds analysis involves placing a sample of the molding composition onto a mold pattern and embedding a piece of wire mesh in the composition. After exposing the composition to curing conditions for 60 seconds, the amount of force necessary to remove the wire mesh is measured. The greater the force required, the greater is the tendency of the molding composition to resist peelback. Peelback refers to the separation of tacky or partially cured molding composition during mold formation his can cause defects (e.g., areas of low wall thickness) not only in the immediately-prepared mold, but also in subsequently prepared molds due to extraneous, residual bodies (i.e., "globs") of bound refractory particulate material (e.g., sand) which mix with the molding composition and cause irregularities and surface imperfections in the molds.

The 30 second invest thickness and invest cure time are both measured by placing a sample of the molding composition having a specified thickness or depth on a hot plate at 232° C.-260° C. (450° F.-500° F.) and then pivoting the plate upside down after 30 seconds of heating to determine the thickness of the cured portion of the molding composition and its cure speed. Finally, the 60 second stick point analysis involves placing a sample of the molding composition along the length of a bar having a temperature gradient along its length. After 60 seconds, loose refractory particulate material is brushed away. The stick temperature is the bar temperature corresponding to the location where the molding composition first remains affixed.

Advantageously, due to the substantial elimination of calcium from the binder (combined with other important, previously described features) molding compositions having favorable hot and cold tensile strength characteristics and other properties described above may be obtained even when at least part of the refractory particulate material (e.g., sand or sand/clay blend) is sand which has been thermally reclaimed. In various embodiments of the invention, at least 25% by weight, at least 50% by weight, at least 75% by weight, at least 90% by weight, and substantially all (i.e., at least 97% by weight) of the refractory particulate material has been thermally reclaimed. Benefits associated with these proportions of thermally reclaimed refractory particulate material are also obtained when the refractory particulate material has been subjected to, in various embodiments, from about 10 to about 150 thermal reclamation cycles, from about 25 to about 150 reclamation cycles, from about 50 to about 150 reclamation cycles, from about 10 to 100 thermal reclamation cycles, from about 20 to about 75 thermal reclamation cycles, or from about 25 to about 50 thermal reclamation cycles. The formation of molds from molding compositions of the present invention (which may contain these substantial proportions of thermally reclaimed refractory particulate material after multiple thermal reclamation cycles) requires curing the binder composition, present in the molding composition, by the application of heat for a sufficient length of time.

In a typical, exemplary method of preparing a molding composition of the present invention, hot sand and a solid phenolic novolac resin are combined at conditions sufficient to melt the phenolic novolac. This generally requires a sand temperature from about 93° C. (200° F.) to about 260° C. (500° F.), and typically from about 105° C. (250° F.) to about 190° C. (400° F.). Uniform coating of the sand with melted phenolic novolac is normally facilitated by mixing, mulling, kneading, or agitating the hot refractory particulate material. The coated sand may thereafter be cooled, prior to adding the phenolic resole resin, usually in an aqueous form. After the addition of this resole resin, together with hexamine (either as an aqueous solution or in solid form with the separate addition of a quantity of water sufficient to dissolve it), and further mixing with the hot coated sand, a heat curable, coated refractory particulate material composition is obtained. This corresponds to the molding composition of the present invention, when the phenolic novolac and phenolic resole resins are substantially free of calcium. The exposure of the resin mixture to the hot sand generally causes the water present in this mixture to evaporate. This results in drying or "B-staging" of the phenolic resins. The coated refractory particulate material is usually mixed until it is free flowing, prior to mold formation. Screening (e.g., on a vibrating screener) is often performed to break down the molding composition and further improve its flow qualities.

A mold for casting metallic articles may then be prepared from this molding composition by forming it into a desired shape using heat and/or pressure and curing the phenolic novolac and phenolic resole resins. This mold forming procedure often involves disposing (e.g., dumping) the resin coated refractory particulate material onto a heated pattern, which cures resin to a desired thickness and shape. The excess, uncured molding composition is then removed, prior to curing the outer surfaces of the molds by the application of external heat. The same general procedures may be employed for the production of either shell or core molds. In the case of shell molds, however, two mold halves are normally affixed together (e.g., by gluing or with additional resin) to form the shell cavity.

Molds prepared in this manner may then be used to prepare cast metal articles by contacting molten metal with the mold. The surface of the molten metal is allowed to cool or "skin over," at which time thermal degradation (or burn out) of the resin and added organic materials in the mold causes the refractory particulate material to be released, such that it essentially reverts back to a free-flowing material. The metal further cools to form the desired cast metal article, having a shape determined by the mold. The released refractory particulate material may thereafter be thermally reclaimed and reused in the further preparation of molds.

All references cited in this specification, including without limitation, all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinence of the cited references. In view of the above, it will be seen that several advantages of the invention are achieved and other advantageous results obtained.

As various changes could be made in the above methods and compositions without departing from the scope of the invention, it is intended that all matter contained in this application, including all theoretical mechanisms and/or modes of interaction described above, shall be interpreted as illustrative only and not limiting in any way the scope of the appended claims.

The following examples are set forth as representative of the present invention. These examples are not to be construed as limiting the scope of the invention as these and other equivalent embodiments will be apparent in view of the present disclosure.

Preparation of Calcium Containing Phenolic Resole

Comparative Example 1

Phenol and formaldehyde (50 wt-% solution) amounts of 600-640 g and 1000-1200 g, respectively, are charged to a reaction vessel. The initial refractive index of this charge, having a calculated formaldehyde/phenol molar ratio in the range of 2.4:1 to 3.0:1, is measured and found to be 1.44-1.48. The reaction vessel contents are then heated and maintained with vacuum reflux and/or cooling coils at 65° C. Several charges (totaling 7-8 g) of 95.5 wt-% $Ca(OH)_2$ are added over approximately 30 minutes. Following the $Ca(OH)_2$ addition, two separate charges of 50% sodium hydroxide of 17.5-18.5 grams each are added over ten minutes. Following the sodium hydroxide additions, the reaction is allowed to exotherm to 70° C. over ten minutes. The 70° C. reaction temperature is maintained with the application of heat as needed. The progress of the reaction is monitored by measuring free phenol content. Samples of the reaction product are analyzed at 60 minute intervals for free phenol, and the target value of 1.19 wt-% is achieved at about two hours and thirty minutes after the final caustic addition.

At this point, the reaction product is vacuum distilled while applying heat and 26 inches of vacuum pressure over thirty minutes. The temperature of the resin drops to 48° C. and distillation continues until the temperature climbs to a target 56° C. endpoint. The refractive index of the reaction product is monitored during the vacuum distillation, and its value gradually increases from 1.52 to 1.57. After one hour of vacuum distillation, the resulting phenol-formaldehyde resole resin is cooled to 40° C., and a 156 gram portion of 28 wt-% ammonia (or 7.85% of ammonia, based on the total formulated weight) is added to neutralize some of the free formaldehyde. The resin is then cooled to room temperature and analyzed. The resin is found to have the following properties: viscosity=690 cps; refractive index=1.5435; free phenol=1.0%; free formaldehyde=1.2%; free formaldehyde@24 hrs=0.70%; solids content=69.08±0.24%.

Preparation of Non-Calcium Containing Phenolic Resoles

Example 1

A phenol-formaldehyde resole resin is prepared as in Comparative Example 1 except that charges of NaOH are used exclusively, in place of the combination of NaOH and $Ca(OH)_2$.

Example 2

A phenol-formaldehyde resole resin is prepared as in Comparative Example 1, except that the reaction is maintained until a 0.5 wt-% target free phenol content is achieved.

Example 3

A phenol-formaldehyde resole resin is prepared as in Comparative Example 1, except that the reaction is maintained until a 0.4 wt-% target free phenol content is achieved. Also, the 156 gram portion of 28 wt-% ammonia is replaced with 6 grams, or 0.31%, of urea based on the total formulated weight.

Preparation of Non-Calcium Containing Phenolic Novolac

Example 4

A 600-650 gram portion of phenol is charged to a reactor along with 5-15 grams of oxalic acid and about 20 grams of water. The charge is heated to 80-90° C. under atmospheric reflux. A 280-310 gram portion of 52% formaldehyde is slowly added over 2 hours. As the formaldehyde is added and reacts with the phenol, the reaction exotherm causes the temperature to increase to about 110° C. and then slowly fall to 100-101° C., as water accumulates in the system, both from the formaldehyde and from the condensation reaction between the phenol and formaldehyde, to maintain reflux conditions.

Following the formaldehyde addition, heat is applied to maintain atmospheric reflux for 2-4 hours. The progress of the reaction is monitored by the drop in free formaldehyde. When the free formaldehyde is less than 0.5% the reaction product is distilled at atmospheric pressure until the temperature reaches 110-120° C. At this temperature, the vacuum is slowly applied until the maximum attainable vacuum pressure (25-27 inches) is attained. Distillation continues under full vacuum until a 150-155° C. endpoint is reached. The product is sampled to verify a free phenol content of 1% by weight or less. A 10-30 gram portion of salicylic acid and a 10-30 gram portion of synthetic wax are added. The resin product is allowed to mix and sampled to determine final specifications. The molten resin product is then pumped to a holding tank, flaked into small irregular pieces, and packaged. The following resin properties are obtained: free phenol content of less than 1.0% by weight, Brookfield viscosity @150° C. (Thermo Cell) of 1,000-2,000 cps, and a salicylic acid content 1.5%-4.5% by weight.

Example 5

The novolac resin preparation of Example 4 is repeated, except that the reactants comprise 600-650 g of phenol, together with 10-30 grams of a co-reactant such as bisphenol-A, cresylic acid, m-cresol, o-cresol, or p-cresol; a 2-6 gram portion of sulfamic acid; and 10-30 grams of water. The temperature obtained initially (due to the reaction exotherm) upon addition of this amount of formaldehyde is about 120° C., rather than about 110° C. The initial distillation, after a free formaldehyde content of less than 0.5% is obtained, is performed under 20 inches of vacuum, rather than at atmospheric pressure. After distillation, the reaction product is sampled to verify a free phenol content of 1.5% by weight or less, rather than 1% by weight or less. When the desired free phenol content was obtained, 10-30 grams of synthetic wax are added to the reaction product, without salicylic acid.

The resin product is allowed to mix and sampled to determine final specifications. The molten resin product is then pumped to a holding tank, flaked into small irregular pieces, and packaged. The following resin properties are obtained: free phenol content of less than 1.5% by weight and a Brookfield viscosity @ 150° C. (Thermo Cell) of 1,000-2,000 cps.

Preparation of Coated Sand (Non-Calcium Containing Phenolic Resole and Novolac)

Example 6

A sample of sand that had been thermally reclaimed using conventional procedures was blended with 1.75% clay in a mixer for about 30 seconds. The blend was heated to 218° C. (425° F.). A sample of phenolic novolac flake resin, which was prepared according to the procedures described in Example 4, was added in an amount representing 3.25% of the weight of the sand, and allowed to melt onto the sand/clay blend. Mixing was carried out for one minute, and a phenolic resole resin, prepared according to the procedures described in Example 1, was added in an amount representing 1.54% of the weight of the sand. After an additional 30 seconds of mixing, hexamine solution, in an amount representing 4.5% of the weight of the phenolic novolac flake resin, was added together with sufficient water to dissolve the hexamine. Mixing was continued until the coated sand was free flowing, at which point the coated sand was discharged, screened, and cooled.

An identical coated sand preparation was performed, but using the phenolic novolac flake resin, which was prepared according to the procedures described in Example 5. The performance of these coated sands, which represented molding compositions, was tested according to various analytical method defined previously. The following results were obtained:

TABLE 1

Coated sand performance on thermally reclaimed sand, clay and resole addition

| Resin | Novolac-Example 4 Resole-Example 1 | Novolac-Example 5 Resole-Example 1 |
|---|---|---|
| Melt point | 93° C. (200° F.) | 87° C. (189° F.) |
| 3-minute Hot tensile | 240 psi | 255 psi |
| 1-minute Cold tensile | 415 psi | 460 psi |
| Peelback @ 60 sec | 2.87 kg | 2.3 kg |
| 30 sec invest thickness | 0.471 inches | 0.456 inches |
| Invest cure time | 125 sec | 128 sec |

Sand coated with non-calcium containing phenolic resole and novolac resins provided good molding properties. Importantly, the cured molding composition showed good strength, despite the fact that the sand had been thermally reclaimed and also that clay was added to the sand.

Example 7

"High Clay" Molding Composition

At a foundry, non-calcium containing phenolic resin binder systems were tested for their ability to form acceptable molding compositions. In one experiment, 521.75 pounds of a proprietary sand/clay blend were mixed in a sand mill. A 16.25 pound charge of the non-calcium containing novolac flake resin, prepared according to the procedures described in Example 4, was added to the sand/clay blend at 146° C. (295° F.), at which temperature the novolac resin melted. Mixing continued for one minute, at which time 7.8 pounds of aqueous, non-calcium containing phenolic resole resin, prepared according to the procedures described in Example 3, was added. Mixing continued at the elevated temperature for an additional minute, and 2.5 pounds of a 30% hexamine solution was added. Mixing continued for an additional 30 seconds to 1 minute before the resulting sand was discharged and screened.

The resulting molding composition exhibited favorable properties for use in the production of molds for metal casting operations. The stick point was measured at 106-107° C. (222-225° F.), the one minute hot tensile strength of the cured composite was about 120 psi, and the three minute hot tensile strength was about 280 psi. Overall good mold formation characteristics were observed.

Example 8

"Low Clay" Molding Composition

A molding composition was prepared as described in Example 6, except that the amounts of clay, non-calcium containing novolac flake resin, non-calcium containing phenolic resole resin, and 30% hexamine solution were 3.75 pounds, 15.25 pounds, 7.2 pounds, and 1.92 pounds, respectively.

The resulting molding composition exhibited favorable properties for use in the production of molds for metal casting operations. The stick point was measured at 98-99° C. (208-210° F.), the one minute hot tensile strength was in the range of 210-320 psi, and the three minute hot tensile strength was about 300-400 psi. Overall good mold formation characteristics were observed.

Use of Non-Calcium Containing Phenol Resole and Novolac in Continuous Sand Mold Preparation in a Foundry, with Thermal Reclamation of the Sand Example 9

At a foundry, 750-1000 pounds of thermally reclaimed sand is mixed in a sand mill with 50-75 pounds of clay to provide a sand/clay blend in a commercial sand mold preparation operation. A 30-50 pound charge of the non-calcium novolac flake resin, prepared as described in Example 4, is added to the sand clay blend at 149° C. (300° F.), at which temperature the novolac resin melts. Mixing continues for one minute, at which time 10-15 pounds of non-calcium containing phenolic resole resin, prepared as described in Example 3, are added. Mixing continues for an additional minute, and 2-3 pounds of hexamine, together with an amount of water sufficient to dissolve it, are added. Mixing continues for an additional 30 seconds to 1 minute before the resulting sand is discharged and screened.

Sand molds are made according to conventional procedures described above, and these molds are used in metal casting operations. The sand is thermally reclaimed and reused to prepare molds. No loss in tensile strength or crumbling of the molds, or any apparent degradation in the quality of the molding compositions (i.e., coated sand) based on analytical testing, is observed over a seven-month period. During this time, the sand/clay blend is subjected to approximately 30-60 thermal reclamation cycles. Metal casting and thermal reclamation operations are continued for an additional seven months, and good mold quality is maintained even after the sand/clay blend is subjected to a total of 60-120 thermal reclamation cycles.

Comparative Example 2

Similar commercial sand mold preparation, metal casting, and thermal reclamation operations were carried out as described in Example 6, except that the phenolic resole resin contained both calcium hydroxide and sodium hydroxide, rather than sodium hydroxide only. As a result, mold crumbling and loss of tensile strength occurred after 3-4 months of operation. During this time, the sand/clay blend was subjected to approximately 10-30 thermal reclamation cycles.

Comparative Example 3

Similar commercial sand mold preparation, metal casting, and thermal reclamation operations were carried out as described in Example 6, except that a one-part phenolic novolac resin (i.e., without added resole) was used. This resin contained a conventional calcium stearate lubricant additive. As a result, mold crumbling and loss of tensile strength occurred after 3 months of operation. During this time, the sand/clay blend was subjected to approximately 10-20 thermal reclamation cycles.

Trace Metals Analysis of Thermally Reclaimed Sand

Example 10

Sand/clay blends which had been thermally reclaimed after being used to prepare sand molds for commercial metal casting operations, were analyzed for trace metals by ICP. A conventional calcium-containing binder was used in preparing the molds. Results are shown below for sand that had undergone both low and high numbers of thermal reclamation cycles. Samples were also added to water at 50/50 w/w with a few drops of detergent added as a wetting agent, and mixed for 30 minutes to obtain a sand pH measurement. These results are also provided.

TABLE 2

Trace Metals Analysis of Virgin and Reclaimed Sand (ppm)

| Element | New Virgin Sand | Low Cycles | High Cycles |
|---|---|---|---|
| Al | 6,310 | 41,500 | 110,000 |
| Ba | 0 | 275 | 738 |
| Ca | 3,700 | 4,470 | 7,210 |
| Cu | 67 | 44 | 78 |
| Fe | 4,740 | 4,790 | 11,300 |
| K | 11,200 | 11,500 | 9,690 |
| Li | 173 | 162 | 19 |
| Mg | 746 | 777 | 1,590 |
| Na | 5,460 | 7,070 | 10,800 |
| Ni | 5 | 50 | 36 |
| P | 16,300 | 18,000 | 14,500 |
| S | 511 | 319 | 380 |
| Si | 12,600 | 38,900 | 56,400 |
| Zn | 448 | 287 | 609 |
| pH | 7.3 | 6.9 | 6.8 |

As indicated in the table above, some accumulation of calcium occurred on the sand over successive thermal reclamation cycles. Also, the addition of clay to the sand apparently caused aluminum to accumulate to very high levels. The presence of calcium and its interactions with aluminum on the sand were believed to result in the observed loss of mold tensile strength after multiple thermal reclamation cycles. The affect of the acidity from the clay (pH=4.5) was also evident from the decrease in pH of the sand as thermal reclamation cycles increased

What is claimed is:

1. A molding composition comprising:

a refractory particulate material suitable for making a mold for casting metallic articles, wherein the refractory particulate material is at least partly coating with a resin mixture comprising:

a phenolic novolac resin;

a phenolic resole resin having a viscosity of from about 100 centipoise to about 5,000 centipoise at a temperature of 25° C.;

hexamine; and less than 1,000 ppm by weight of calcium based on the combined dry solids weight of the phenolic novolac resin and the phenolic resole resin wherein the phenolic novolac resin has a dry solids weight of from about 60% to about 99%, based on the combined dry solids weight of the phenolic novolac resin and the phenolic resole resin, and wherein the phenolic resole resin contains from about 55% to about 75% solids.

2. The molding composition of claim 1, wherein the resin mixture comprises less than 500 ppm by weight of calcium based on the combined dry solids weight of the phenolic novolac resin and the phenolic resole resin.

3. The molding composition of claim 1, wherein the resin mixture comprises less than about 100 ppm by weight of calcium based on a combined dry solids weight of the phenolic novolac resin and the phenolic resole resin.

4. The molding composition of claim 1, wherein the phenolic novolac resin has a dry solids weight of from about 75% to about 95%, based on the combined dry solids weight of the phenolic novolac resin and the phenolic resole resin.

5. The molding composition of claim 1, comprising hexamine at from about 1% to about 5% by weight of the resin mixture.

6. The molding composition of claim 1, wherein the phenolic resole resin comprises the product of the reaction of formaldehyde and phenol at a molar ratio of formaldehyde: phenol from about 2.5:1 to about 3.5:1, and wherein the phenolic novolac resin comprises the product of the reaction of formaldehyde and phenol at a molar ratio of formaldehyde: phenol from about 0.7:1 to about 0.9:1.

7. The molding composition of claim 1, having a weight ratio of refractory particulate material to combined dry solids of the phenolic novolac resin and the phenolic resole resin in the resin mixture of from about 10:1 to about 35:1.

8. The molding composition of claim 1, wherein the refractory particulate material is sand and the molding composition further comprises clay at from about 1% to about 10% by weight of sand.

9. The molding composition of claim 1, wherein at least part of the refractory particulate material has been thermally reclaimed.

10. The molding composition of claim 1, wherein the phenolic resole resin comprises sodium hydroxide at from about 1% to about 5% by weight of the phenolic resole resin solids.

11. The molding composition of claim 1, wherein the phenolic resole resin comprises salicylic acid at less than about 5% by weight of the phenolic resole resin solids.

12. The molding composition of claim 1, wherein the phenolic resole resin comprises urea at from about 0.3% to about 3% by weight of the phenolic resole resin solids.

13. The molding composition of claim 1, wherein the phenolic resole resin comprises free phenol at less than about 0.5% by weight, as measured by the total weight of the phenolic resole resin.

14. The molding composition of claim 1, wherein the phenolic resole resin has a concentration of free formaldehyde of less than about 1% by weight based on the phenolic resole resin solids.

15. The molding composition of claim 1, wherein the phenolic resin has a number average molecular weight ($M_n$) ranging from about 50 to about 1,000 grams/mole.

16. The molding composition of claim 1, having a one minute cold tensile strength of at least about 400 psi when the resin mixture is cured.

17. The molding composition of claim 1, having a three minute hot tensile strength of at least about 225 psi when the resin mixture is cured.

18. The molding composition of claim 1, having a peelback at 60 seconds of at least about 2 kg when the resin mixture is cured.

19. The molding composition of claim 1, wherein the molding composition has a one-minute hot tensile strength of about 120 psi to about 160 psi when the resin mixture is cured.

20. A method for preparing a molding composition, comprising:

combining a refractory particulate material and a solid phenolic novolac resin at conditions sufficient to melt said phenolic novolac resin and yield an at least partly coated refractory particulate material; and adding a phenolic resole resin and hexamine to said at least partly coated refractory particulate material to yield said molding composition, wherein the phenolic resin has a viscosity from about 100 centipoise to about 5,000 centipoise at a temperature of 25° C., wherein the phenolic resole resin contains from about 55% to about 75% solids, wherein said phenolic novolac resin and said phenolic resole resin are substantially free of calcium, such that the molding composition has less than 1,000 ppm by weight of calcium based on the combined dry solids weight of the phenolic novolac resin and the phenolic resole resin, and wherein the phenolic novolac resin has a dry solids weight of from about 60% to about 99%, based on the combined dry solids weight of the phenolic novolac resin and the phenolic resole resin.

21. The method of claim 20, wherein said conditions comprise mulling, kneading, or agitating said refractory material at a temperature from about 105° C. to about 190° C.

22. The method of claim 20, further comprising, prior to or during said adding step, cooling said coated refractory particulate material.

* * * * *